United States Patent [19]

Schmidgall et al.

[11] Patent Number: 4,708,621

[45] Date of Patent: Nov. 24, 1987

[54] CONCRETE PIPE MAKING MACHINE

[75] Inventors: Hartzell H. Schmidgall; Jon A. Schmidgall, both of Mediapolis, Iowa

[73] Assignee: Hawkeye Concrete Products Co., Mediapolis, Iowa

[21] Appl. No.: 813,844

[22] Filed: Dec. 27, 1985

[51] Int. Cl.[4] ..... B28B 21/16; B28B 21/24

[52] U.S. Cl. ..... 425/183; 425/186; 425/195; 425/253; 425/259; 425/361; 425/407; 425/413; 425/421; 425/436 R; 425/441; 425/447; 425/456

[58] Field of Search ..... 264/69, 71, 72; 425/182, 183, 185, 195, 259, 361, 253, 436, 441, 457, 456, 261, 348 R, 421, 423, 436 R, 454, 186, 407, 447, 413

[56] References Cited

U.S. PATENT DOCUMENTS

| | | | |
|---|---|---|---|
| 975,104 | 11/1910 | Allen | 425/361 |
| 1,075,936 | 10/1913 | Pelke et al. | 425/447 |
| 2,321,277 | 6/1943 | Boyle | 425/421 |
| 2,356,852 | 8/1944 | Hutchinson | 264/72 |
| 2,888,731 | 6/1959 | McElroy et al. | 425/421 |
| 2,926,411 | 3/1960 | Steiro | 425/421 |
| 3,334,390 | 8/1967 | Steiro | 425/421 |
| 3,677,674 | 7/1972 | Bowles | 425/261 |
| 3,696,182 | 10/1972 | Joelson | 264/72 |
| 3,901,642 | 8/1975 | Urmanov | 425/456 |
| 4,118,165 | 10/1978 | Christian | 425/253 |
| 4,226,568 | 10/1980 | Christian | 425/253 |
| 4,248,580 | 2/1981 | Christian | 425/253 |

*Primary Examiner*—Willard E. Hoag
*Attorney, Agent, or Firm*—James C. Nemmers

[57] ABSTRACT

A machine for making concrete pipe in which multiple-form sets can be coupled into one module so as to increase production output of the machine without an increase in machine manpower. The multiple-form modules are provided with adapters that make them compatible with conventional single-mode form sets and all cycles of production so that multiple-form modules can be used simultaneously with single-mode form sets. The multiple-form sets also utilize core vibration throughout the fill cycle, but unlike conventional core vibration systems, the amplitude and direction of vibration are continuously varied to distribute the vibration uniformly throughout the length of the pipe being formed.

7 Claims, 12 Drawing Figures

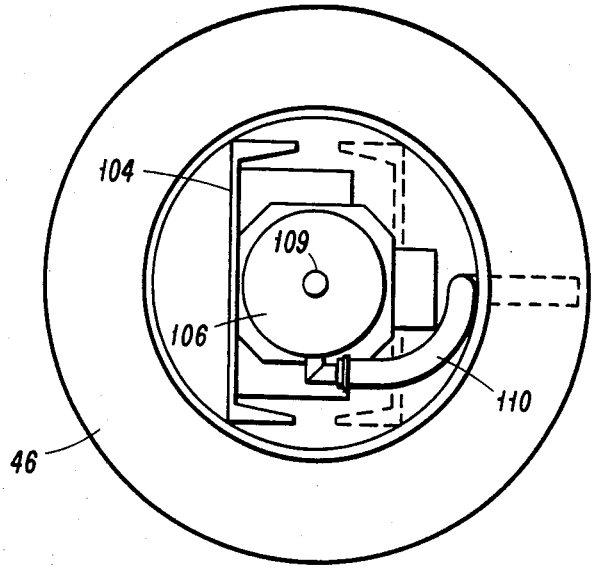
FIG 9
FIG 10
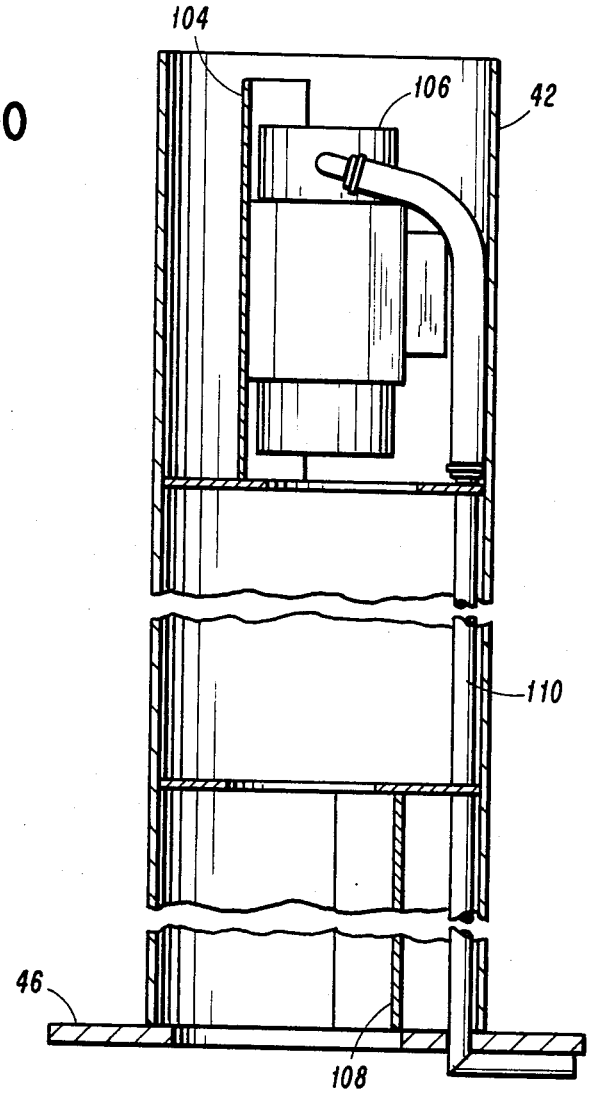

FIG 11
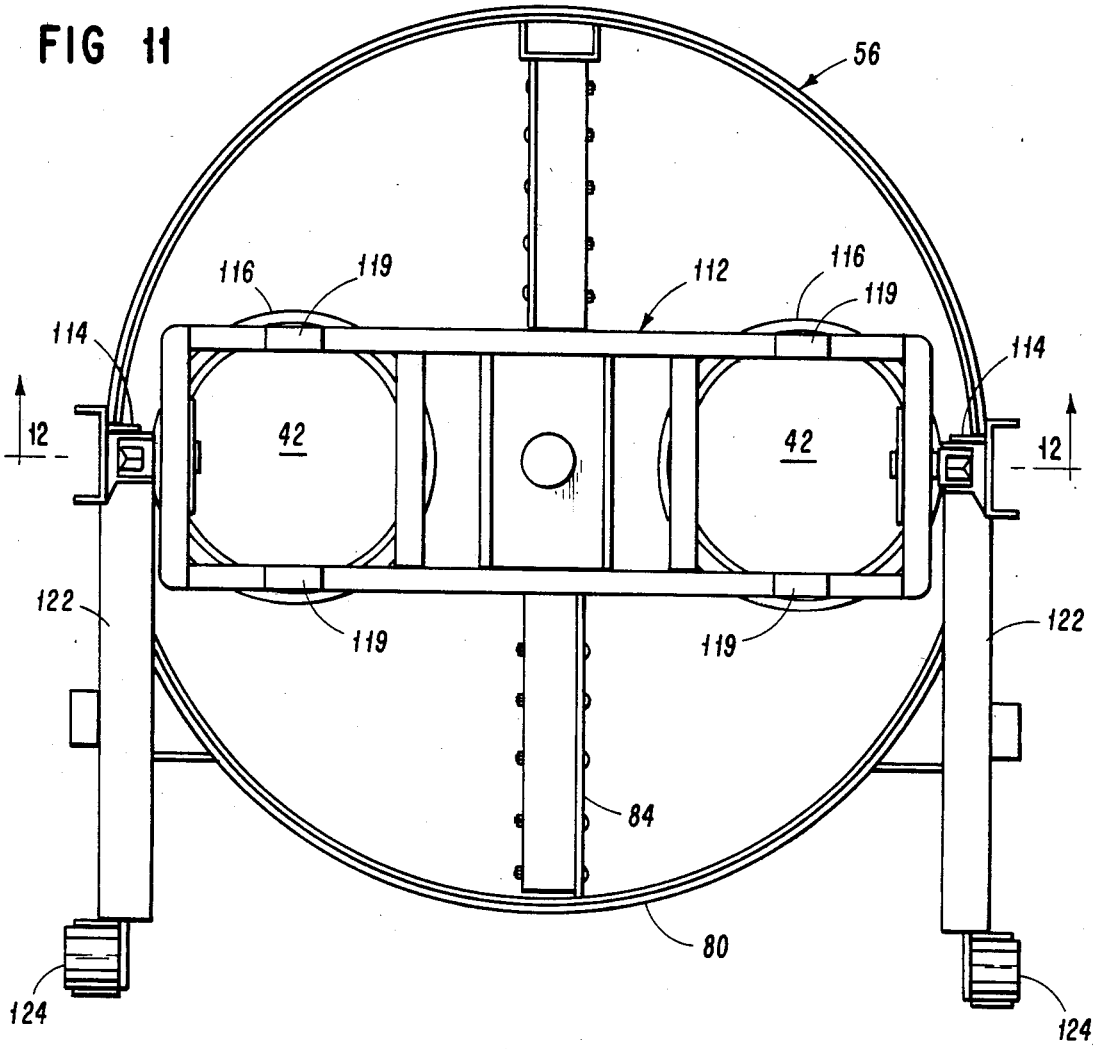
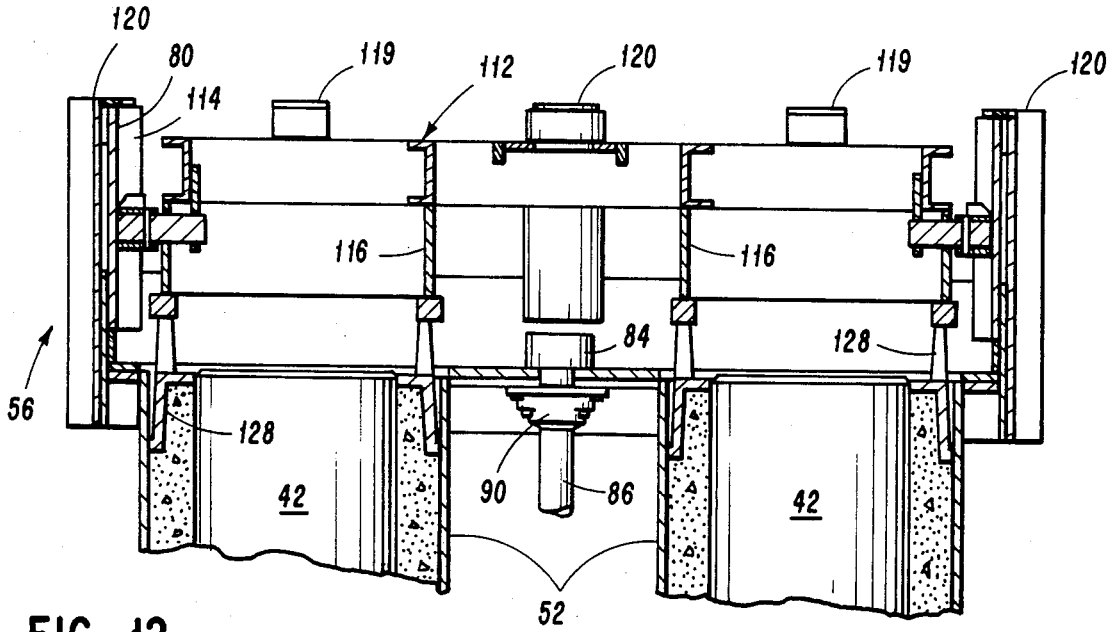
FIG 12

CONCRETE PIPE MAKING MACHINE

BACKGROUND OF THE INVENTION

This invention relates to multiple station machines for producing concrete pipe and other similar concrete products.

There are known and used in the industry numerous designs of machines for producing concrete pipe and other similar products. Some of these machines are single station machines, while others are multiple station machines. The latter type machines generally have three stations at which the basic cycles of filling, pressure-heading and stripping are simultaneously performed. With the conventional multiple station machine, a module for each station is secured to a turntable that is usually mounted below the floor level. A jacket with a removable pallet secured to its lower end is lowered over the core at each station, and the annular space between the core and jacket is then filled with concrete at the filling station while the jacket is vibrated. The turntable is then rotated so that the filled form is at the pressure heading station where a pressure head is lowered on to the top of the form to compact the concrete. Vibration is generally completed at the pressure heading station, and preferably the pressure-head is equipped with a tongue-trowel which revolves the top joint frame during vibration to produce a smooth, trowel-finished joint. At the third station, the jacket and pallet together with the now-formed concrete pipe is stripped form the core and moved to the curing area. The jacket is then released from the pallet and lifted from the now-formed pipe. A new pallet is then added to the jacket and the form is returned to the filling station and lowered over the core.

There are numerous, obvious advantages to a multiple station machine since production rates can be substantially increased and size changeovers can be quickly made. The forms at each of the three stations can be of either different diameters of the same size. In an effort to increase production rates, some machines have a cluster of forms at a single station, but all machines of this type strip both the jacket and core at the forming station with the formed, uncured pipes being moved to the curing area while still wet and not secured. Since the stripping step is the most time consuming step in the pipe making process, further increased productivity could be accomplished if a multiple form set could be combined into a single module with means being provided to strip all forms in a module simultaneously without the necessity of modifying the standard feeding, pressure heading and stripping equipment. However, there is not known a machine which has these features.

Also, if a multiple-form per module type machine is to be used, it would also be desirable to simplify the stripping operation by eliminating vibrator cord handling on the jackets.

It is therefore the principal object of the invention to provide a multiple station pipe forming machine which couples multiple form sets into a single module at each station thus substantially increasing the production output with no increase in machine manpower.

SUMMARY OF THE INVENTION

The invention provides a multiple-station, multiple-form per module arrangement for concrete pipe machines, which arrangement is fully compatible with existing multi-station machines of a similar design and which will utilize the standard filling, pressure heading and stripping extruder of such machines. The multiple forms are coupled together into a single module so that they can be picked up as a unit, all filled simultaneously and pressure headed and stripped at the same time with the standarized equipment of existing machines. The manner in which the forms are coupled is combined with a core vibration system that is unique for core vibration in that it produces variable amplitude and variable direction so as to distribute the vibration forces uniformly throughout the length of the pipe.

The machine of the invention accomplishes the foregoing by using an adapter pan that is part of the module, the adapter pan permitting feeding with the standard feed chute of machines of this type. A combination heading/stripping adapter is used to simultaneously head each pipe with the standard press head, and the adapter also allows the use of the standard stripping extruder used with machines of this type.

The machine of the invention thus provides for increased production output with no increase in machine manpower, and also provides for easy adaptation of existing machines to utilize the multiple form per module system.

BRIEF DESCRIPTION OF THE DRAWINGS

FIG. 9 is a top view of a core and illustrating the vibrator;

FIG. 10 is a side elevational view mostly in section and illustrating the core vibrator;

FIG. 11 is a top plan view illustrating the head/stripper adaptor in place on top of a two-form set; and FIG. 12 is a sectional view taken on the line 12—12 of FIG. 11.

DESCRIPTION OF THE PREFERRED EMBODIMENT OF THE INVENTION

Figure 1:
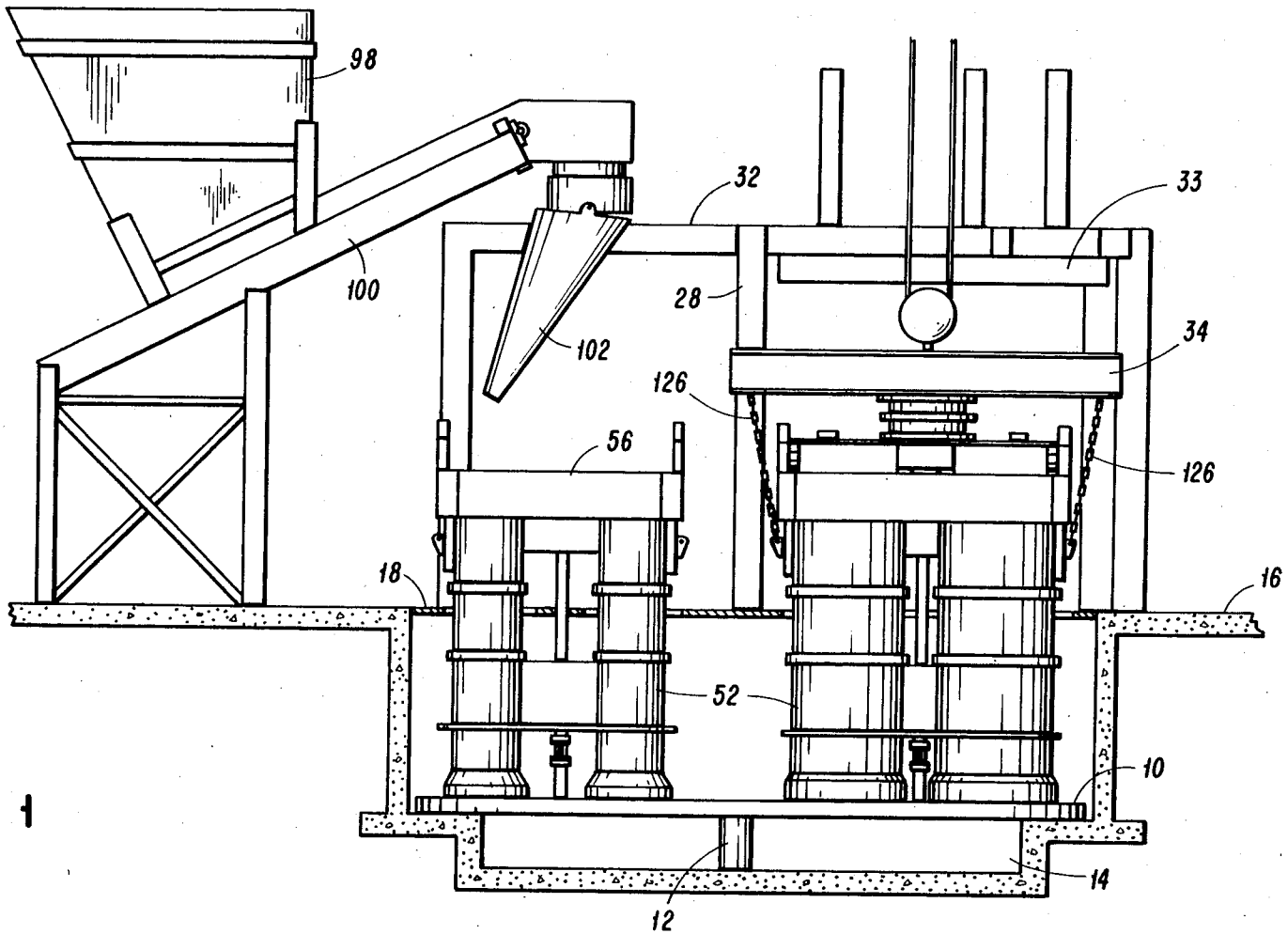
FIG. 1 is a side elevational view, partly in section, showing the machine constructed according to the principles of the invention.
Figure 2:
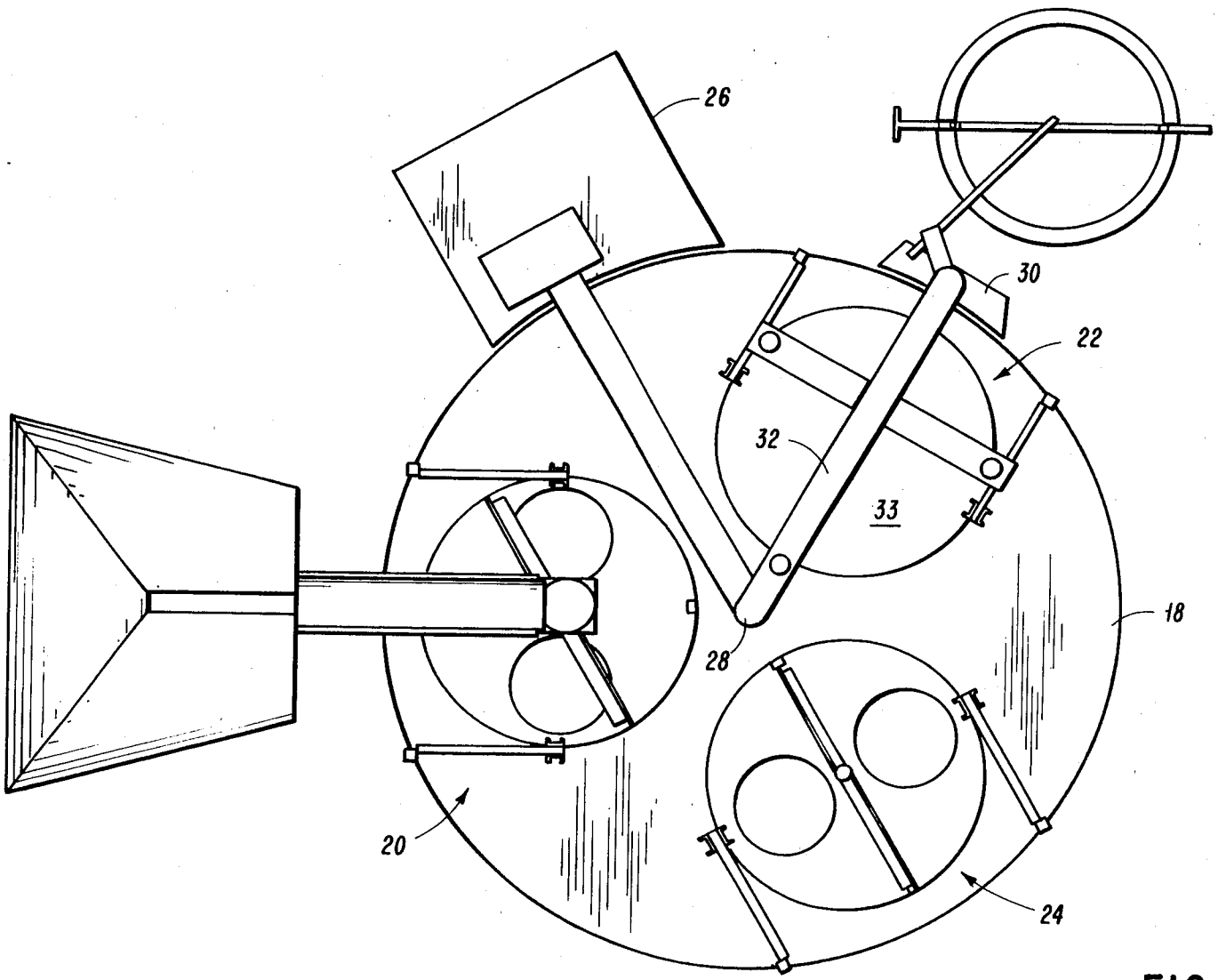
FIG. 2 is a top or plan view of the machine of FIG. 1 and illustrating the three stations.
Figure 3:
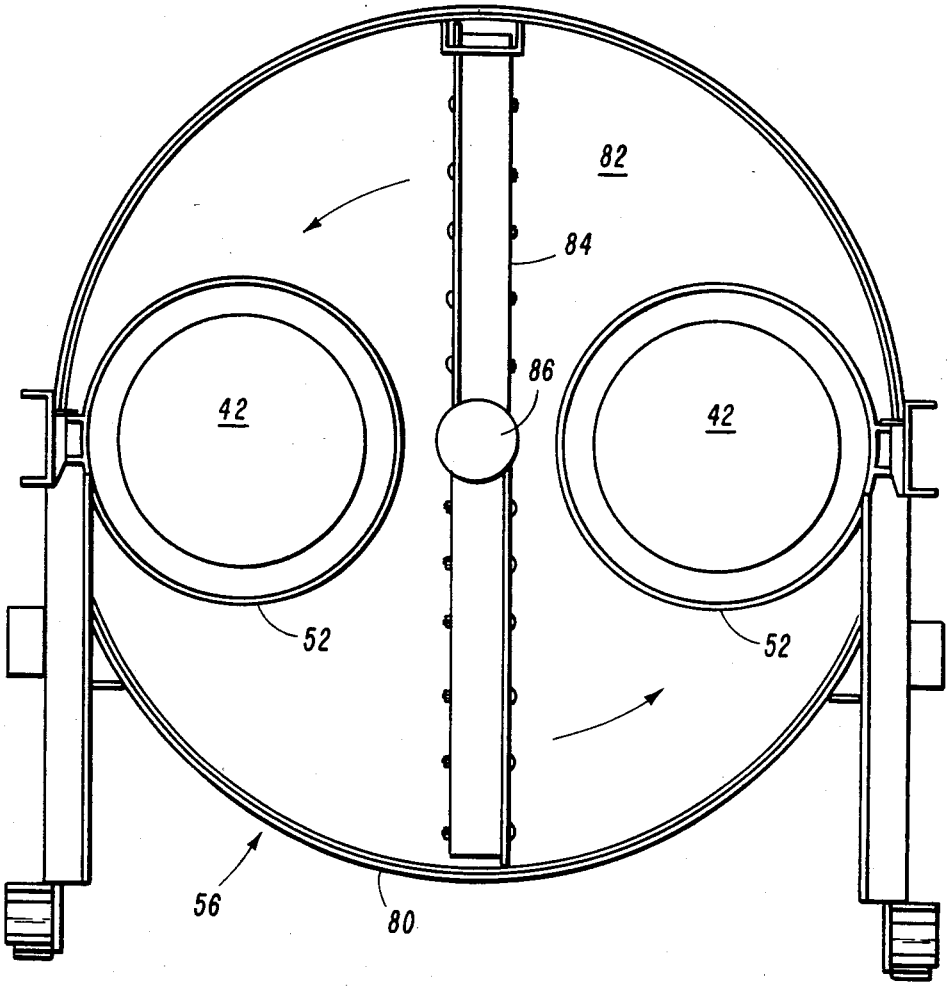
FIG. 3 is a top or plan view of the feed pan for a two-form set module.

Referring now to the drawings, and particularly to FIG. 1 and FIG. 2, the operating stations of the machine are spaced around a turntable 10 mounted for rotation about a central support 12 in a pit 14 formed below the level of the floor 16. The pit 14 is usually covered with a removable cover 18 which has a plurality of openings in it and through which extend the forms that will be described in detail hereinafter. Cover 18 is supported by and rotatable with turntable 10 in any suitable manner as is well known with existing conventional multi-station machines of this type.

As best seen in FIG. 2, the machine has a fill station 20, a pressure-head station 22 and an offbear or stripping station 24. In the preferred embodiment, we have shown at each of the stations a module consisting of two-form sets. The machine also preferably includes an operator station 26 at which the controls are centralized so that one man can operate the machine. The machine also includes a main vertical support 28 and a side vertical support 30 that are interconnected by horizontal support 32 to provide the necessary supporting structure for the pressure head 33 which is vertically movable at the pressure-head station 22. The pressure head 33 and its function will be described in more detail hereinafter.

In addition, an overhead beam 34 (FIG. 1) is supported on a suitable overhead tram (not shown) so that the beam 34 can be moved up and down and to different positions thus providing for placement of the form sets in place and removing them after the concrete pipe has been formed and must be transferred to a curing area.

Figure 4:
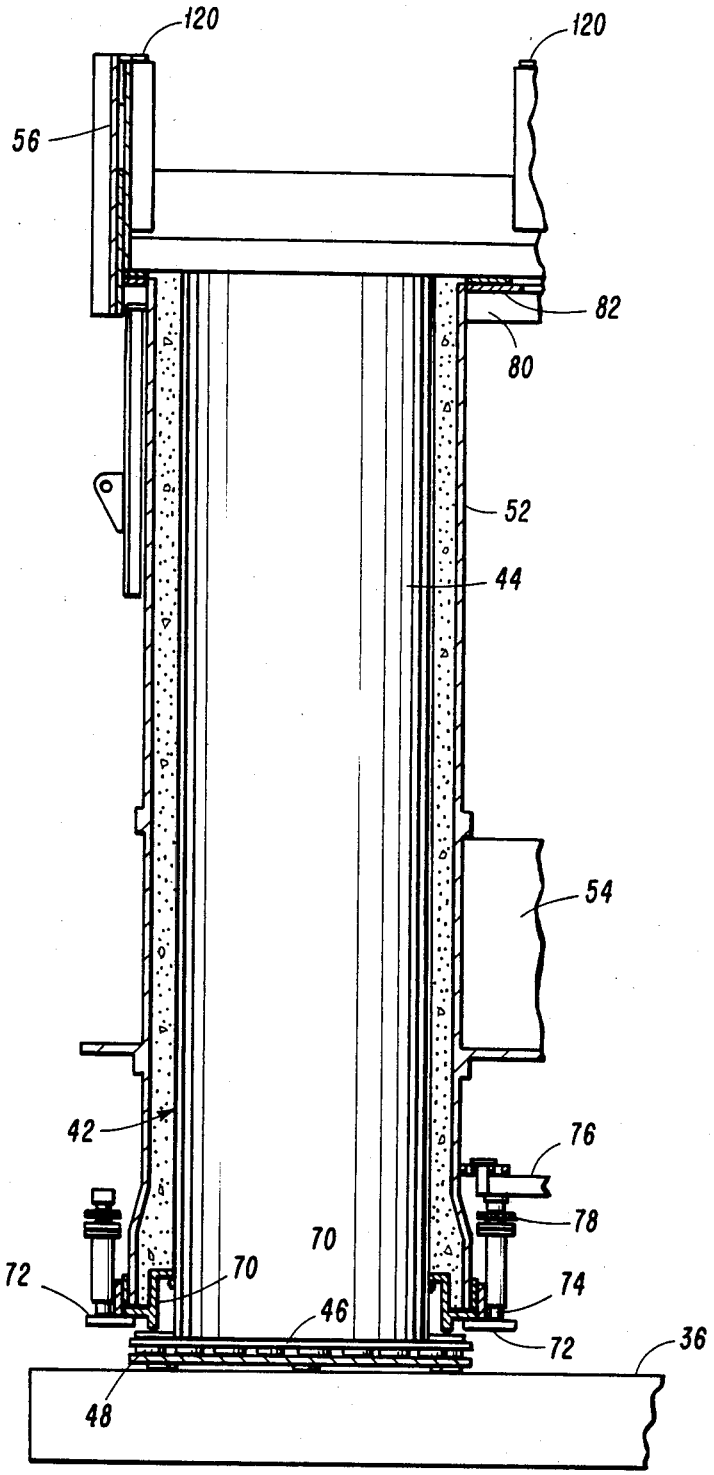
FIG. 4 is a sectional view through an elevation of one form of a two form set and illustrating the method of attachment of the jacket, pallet, core and base.
Figure 5:
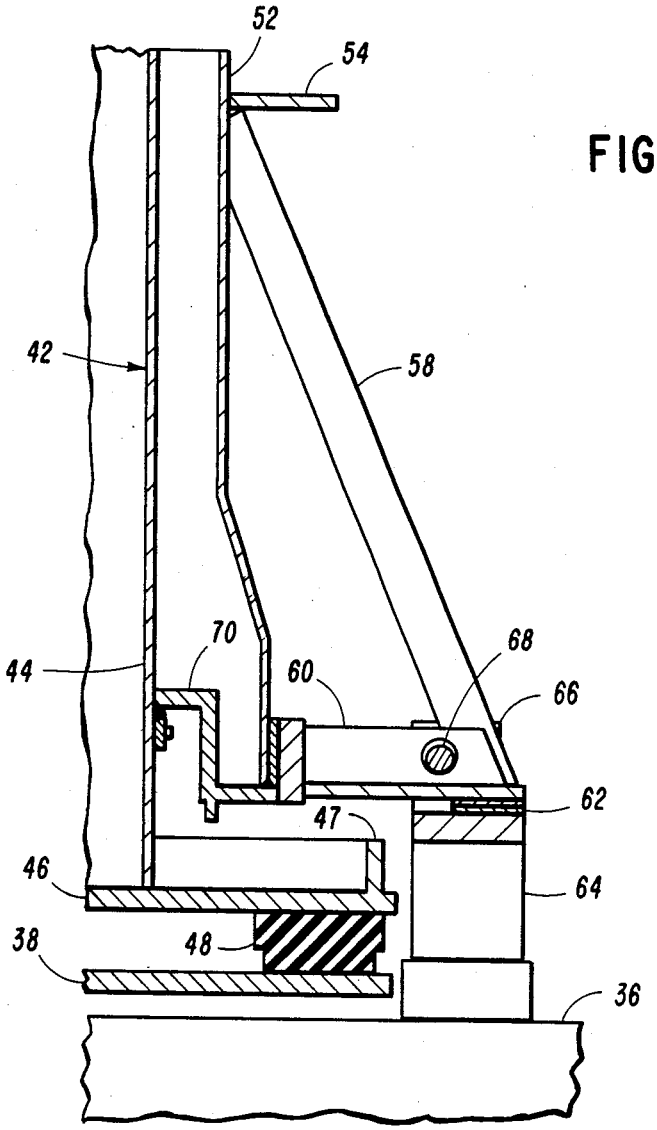
FIG. 5 is an enlarged sectional view of a portion of a two-form set and illustrating the connection between the jacket, core, and base.
Figure 6:
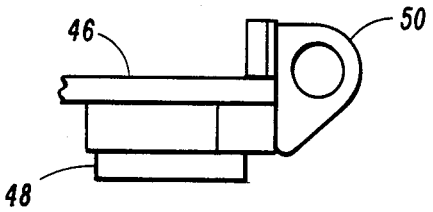
FIG. 6 is an enlarged view showing one of the core lifting eyes.
Figure 7:
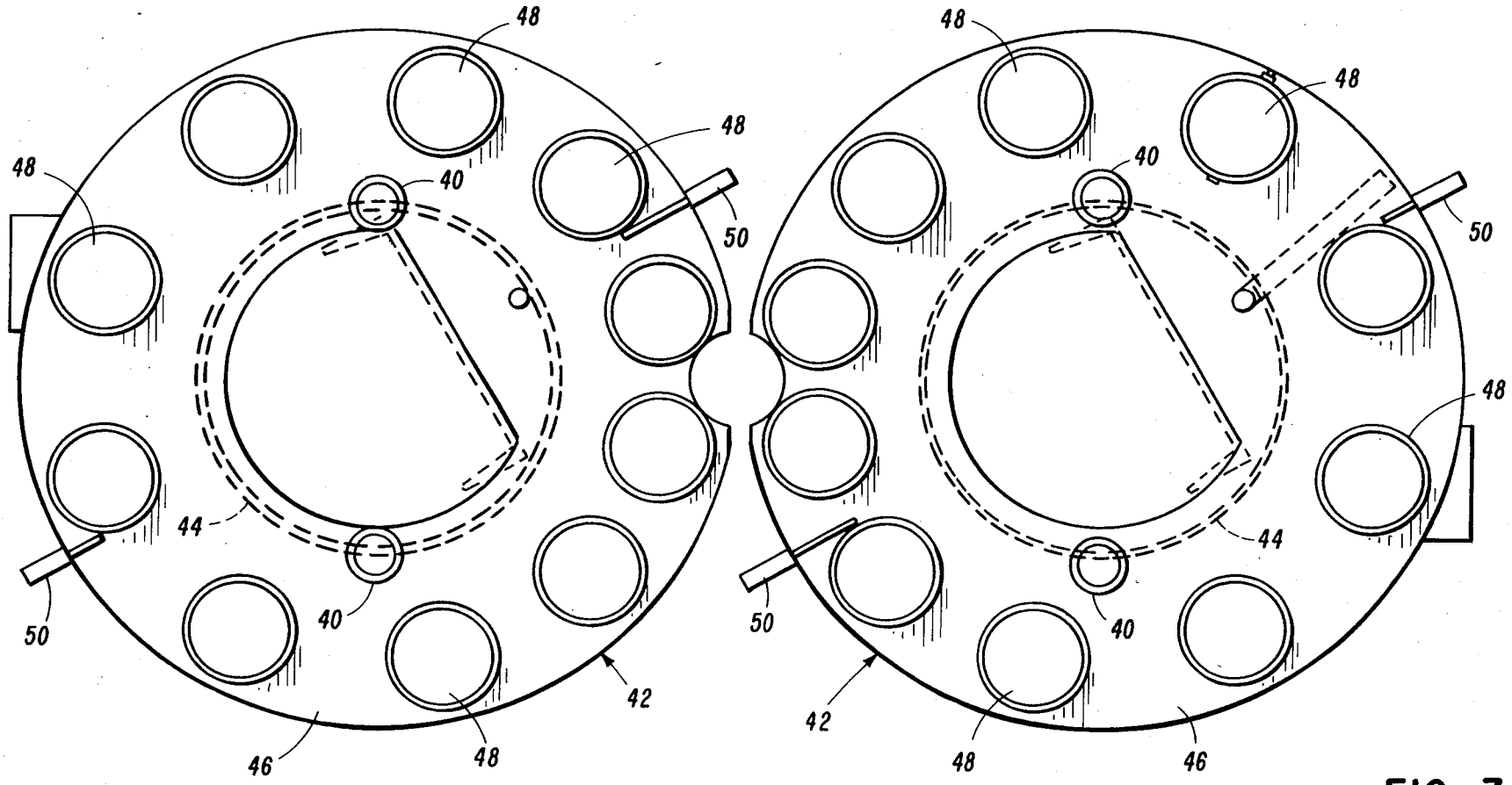
FIG. 7 is a bottom view of the cores for a two-form set.

Referring now to FIGS. 3, 4, 5, 6, 7, and 8 as well as FIG. 1, the structure of a form set and related supporting structure will now be described. Each form set has a suitable supporting base 36 which rests directly upon the turntable 10. Suitable means (not shown) can be provided to secure the base 36 to the turntable so that it will rotate with it. The base is generally rectangular in shape and has affixed to it a circular support plate 38 which can be provided with vertical guide pins (not shown) that fit into guide openings 40 (FIG. 7) in the bottom of each of the cores indicated generally by the reference numeral 42. Each core 42 consists of a vertical cylindrical tube 44 that is preferably hollow, tube 44 being affixed to a cylindrical base 46 that has a plurality of rubber isolators 48 secured beneath it and which rest directly upon the circular support plate 38. Base 46 may also be provided with an annular ring 47 near its outer edge which ring 47 serves as a dam to control any concrete that may leak from the bottom of the form during the production cycles. The cores 42 are thus not positively affixed in any manner to the base 36 so that the cores, although positively positioned by the guide openings 40, are free to be vibrated in the manner described hereinafter. To prepare the machine for use with a multiple form set in each module, the base 36 each containing two or more cores 42 is positioned on the turntable 10, and is thus in a position to receive the jackets and related structure that complete the form set. If desired, and to aid in lifting the cores 42 in place on the base 36, suitable lifting eyes 50 can be secured at diametrically opposite positions to the core base 46 as shown in FIG. 6.

A two-form set is shown in the preferred embodiment described herein, but the principles of the invention could be applied to a module consisting of more than two forms. A jacket, indicated generally by the reference numeral 52, is provided for each form, and thus a pair of jackets 52 are rigidly connected together in each form set. The jackets 52 are connected by a suitable intermediate connecting member 54 and are also connected at their uppermost ends by a built-in feed pan indicated generally by the reference numeral 56. Each jacket 52 is generally a hollow cylindrical tube the inside diameter of which is greater than the outside diameter of the corresponding core 42. Also, a pair of jackets 52 that complete the form set are accurately spaced-apart so that when properly positioned on the support base 36 in the manner described hereinafter, the annular space between the jacket 52 and each corresponding core 42 will form the thickness of the wall of the pipe to be formed.

The jackets 52 are provided with a pair of angular support arms 58 that are rigidly connected at their lower ends to horizontal supports 60 that are in turn welded or otherwise suitably secured to the lower end of each jacket 52 (see FIG. 5). The lower end of each support arm 58 also has a small support plate 62 that rests on top of an upstanding support arm 64 that is secured to the base 36 as shown in FIG. 5. At least two of the support arms 64 (one on each side of each jacket 52) are provided with spaced apart vertically extending attachment plates 66 between which the support plate 62 rests. This positively positions the jackets 52 relative to the base 36, and to secure the jackets in place during transport of the form set, a locking pin 68 is inserted through aligned openings in the attachment plates 66 and the horizontal support 60 (see FIG. 5.) The pins 68 are removed during the production cycles.

Also, as is customary with machines of this type, a pallet 70, which is basically an annular ring, is removably attached to the bottom of each of the jackets 52 in a well known manner. The attachment mechanism consists generally of locking lugs 72 (FIG. 4) that are affixed to turnable vertical rods 74 that are manually turned by a lever 76 through a chain (not shown) operatively connected to sprockets 78 secured to each of the vertical rods 74. Thus, a pallet 70 will be secured to the lower end of each jacket 52 prior to the time that the jackets 52 are lowered over the cores 42. The pallets 70 positively position the jackets 52 relative to the cores 42 thereby accurately determining the wall thickness of the pipes. The pallets 70 also provide the form to shape the end of the pipes to the desired configuration.

Figure 8:
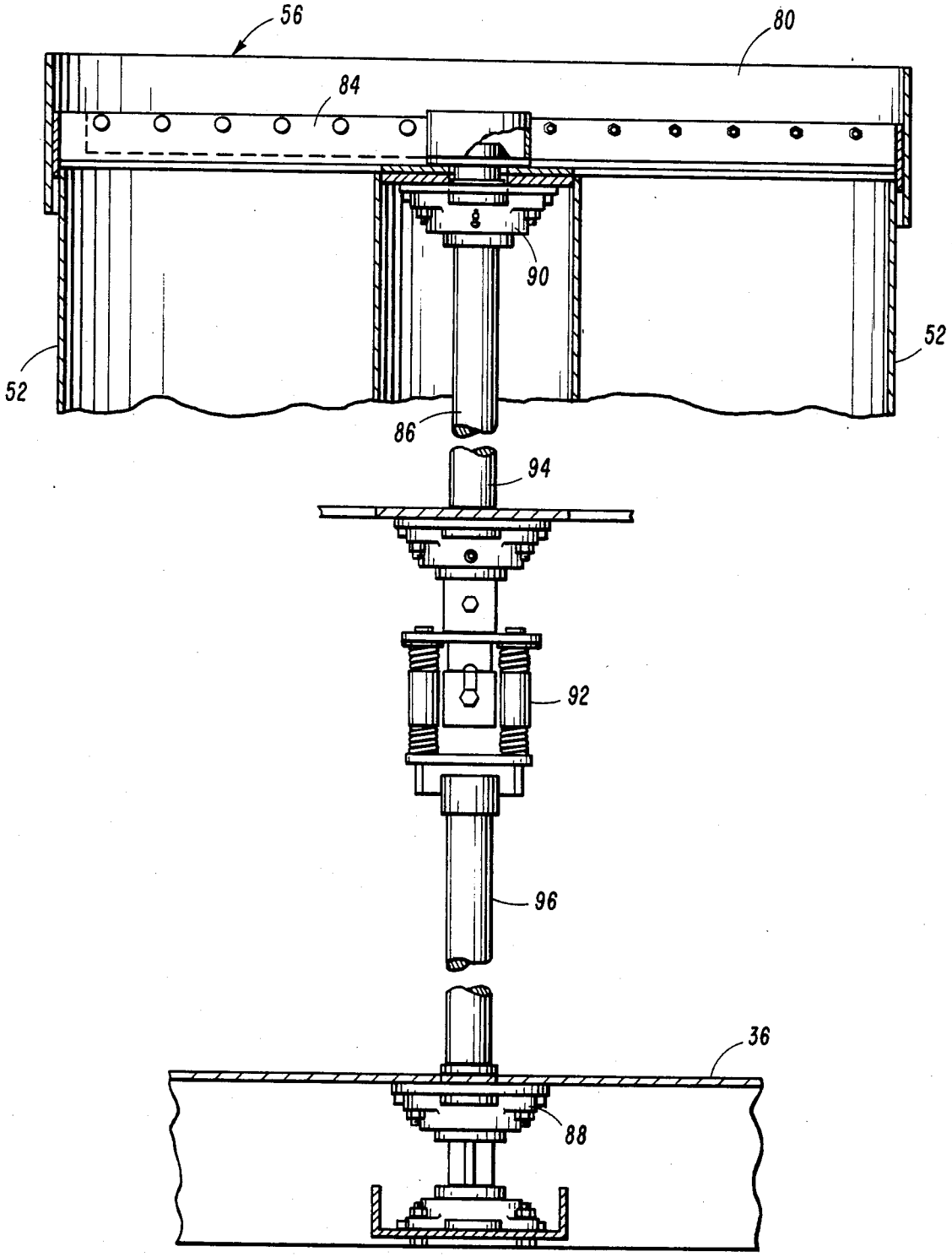
FIG. 8 is a side view, partly in section, of a form set and showing the drive for the feed pan rotor but showing portions of the feed pan removed for purposes of clarity.

As previously indicated, each form set consisting of two interconnected jackets 52 includes a feed pan 56 that is permanently affixed to the top of each of the jackets 52. The feed pan 56 includes an annular ring that encompasses the pair of jackets 52 in each form set. The feed pan 56 also includes a bottom 82 which has a pair of circular openings the diameters of which form the upper open ends of the jackets 52. (See FIG. 3). As best seen in FIG. 4, an annular ring 80 extends above the open upper ends of the jackets 52 so as to form a pan for receiving the concrete to be filled into the form set to form the concrete pipe. Inside of the feed pan 56, there is provided a rotor 84 turnable about a central vertical shaft 86. As rotor 84 rotates, it spreads the concrete evenly into both forms of the module. A central shaft 86 extends downwardly between the jackets 52 and into the base 36 as best seen in FIG. 8. The shaft 86 is mounted in suitable bearings, such as the lower bearing 88 secured to base 36 and the upper bearing 90 secured to the bottom 82 of the feed pan 56. The shaft 86, and thus the rotor 84, are driven from a suitable power means (not shown), and the shaft is preferably provided with a coupling 92 that separates the upper portion 94 from the lower portion 96 of shaft 86. The coupling 92 provides for automatic engagement of the upper portion 94 with the lower portion 96 as the jackets 52 are lowered over the cores 42 onto the base 36. Also, the coupling 92 will provide for automatic disengagement when the module is offborn from the machine for transportation to the curing area for stripping.

At the fill station 20, there is of course provided the standard hopper 98 and a conveyor 100 at the outer end of which is a fill chute 102 that can be moved into position over the feed pan 56 during the filling cycle.

One of the features of the invention is the means of providing vibration during the fill and pressure-head cycles. In FIGS. 9 and 10, there is illustrated a vibrating system mounted inside of the cores 42. Each core 42 is provided with an internal vertical support plate 104 to which there is affixed a vibrator 106 at the upper end of the core 42. Similarly, at the lower end of the core 42 there is a vertical support plate 108 which supports a similar vibrator (not shown). The top vibrator 106 has an opening 109 that communicates with an air line 110 to provide for removal of the heat inside of core 42 that is generated by the vibrators. The upper and lower vibrators 106 are synchronized so that they will cause the upper end of the core 42 to vibrate in an circular path opposite to the direction at the lower end of the core 42. In other words, if the vibrator at the upper end of the core 42 is operated to cause circular movement of core 42 in a counterclockwise movement, the vibrator at the lower end will cause the lower end of the core 42 to vibrate in a circular motion in a clockwise direction. Thus, this unique combination continuously varies both the amplitude and direction of the vibration of the core 42 throughout the fill and pressure heading cycles. This actually pumps the concrete for faster packing and uniformly distributes vibration throughout the entire length of the core. This vibration system also eliminates concentrations of vibration that could overly excite concrete particles beyond proper compaction and eliminates hot spots or voids in the wall of the finished pipe.

Referring now to FIGS. 11 and 12, there is shown the pressure-head extruder indicated generally by the reference numeral 112. This rectangular shaped unit 112 fits into a vertically-extending support 114 at each end, and unit 112 contains annular shaped heads 116 which engage top joint rings 128 that extend downwardly into the annular space between each of the jackets 52 and their corresponding cores 42. Unit 112 has upwardly extending lugs 119 (FIG. 12) that are engaged by the conventional pressure head 33 (see FIG. 1), to apply pressure to the top joint rings 128 until the stops 120 on the top of feedpan 56 are engaged. During the pressure-head cycle, the vibrators 106 are actuated and the concrete is thus compacted to form the pipe.

If desired, horizontally extending support tubes 122 (FIGS. 11 and 12) can be affixed to the top of the feedpan 56, tubes 122 extending parallel to each other and outwardly from the supports 114. At the outer end of each of the support tubes 122, there can be provided cradles 124 which can be used to store the pressure-head extruder unit 112 when not in use. When the unit 112 is stored in the cradles 124, it is generally turned 90° to a vertical position. The unit 112 is stored in this cradle only during the fill cycle, as unit 112 is used during both the pressure-heading and stripping cycles.

After the pressure-heading step has been completed and the turn table 10 rotated to move a module to the stripping station 24, the module is lifted from the base 36. The form set, consisting of the jackets 52 with pallets 70 attached, is stripped from the cores 42 in a conventional manner by using the overhead beam 32 which is connected to the module using the chains 126 as shown in FIG. 1. The module is then transported to the curing area where the pallets 70 are released from their connection to the jackets 52 and the module then stripped from the now finished pipe. The off-bearing and stripping is greatly simplified due to the elimination of any vibrator cord handling, the vibrators 106 being inside of the cores which remain on the base 36.

Having thus described the preferred embodiment of the invention, the operation should be evident to those skilled in the art from the foregoing description. However, the operation will now be summarized for purposes of clarity.

With a form set in place on the turn table 10 at each of the three stations, the module properly positioned at the fill station 20 will be filled with concrete. The chute 102 is positioned to drop the concrete approximately halfway between the center and outside edge of the feedpan 56. The chute 102 is preferably revolved in the direction opposite to the direction of rotation of the rotor 84. During the entire fill cycle, the vibrators 106 are actuated, and when the concrete is to the top of the cores 42, the rotor 84 is stopped so that the remaining concrete in the feedpan 56 is centered over the tops of the cores 42. When the forms are completely full and done settling due to the vibration, the rotor 84 is then rotated once more over the tops of the forms for final leveling. During the time that the rotor 84 is stopped for final filling of the forms, the operator can move the chute 102 out of the way and position the pressure-head extruder unit 112 on the cradles 124 unless this was previously done. After the forms are filled, the vibrators 106 are turned off, and the turn table 10 is rotated to move the now-filled form set to the pressure-head station 22.

At the pressure-head station 22, the top joint rings 128 (FIG. 12) are placed in position over the cores 42, and the pressure-head extruder unit 112 is moved from cradles 124 into place in supports 114 which serve as guides for vertical movement of the unit 112. With the vibrators 106 again running, the pressure head 33 is moved downwardly to engage the lugs 119 on unit 112 forcing the unit 112 and top joint rings 128 downwardly to compact the concrete in the forms. Downward movement is continued until the pressure head 33 engages the stops 120 on the feedpan 56. FIG. 12 shows the components in their relative positions at the end of the pressure head cycle with the pressure head 33 in its lowest position. The vibrators 106 are allowed to run for a short time after the pressure head cycle is completed. The vibrators are then turned off and the pressure head 33 is raised.

The turn table is then rotated to move the module to the stripping or offbear station 24. The beam 34 is then connected to the jackets 52 by use of the chains 126, and the module is lifted and stripped from the cores 42 and transported to the curing area where the locking lugs 72 that lock the pallets 70 in place are opened and the module is lifted and stripped from the now-formed pipe which remains in the curing area with the pallet 70 and top joint ring 128 in place until the pipe is fully cured.

Having thus described the invention in connection with a preferred embodiment of it, it will be evident to those skilled in the art that various revisions and modifications can be made to the preferred embodiment without departing from the principles of the invention. It is our intention however that all such revisions and modifications as are obvious to those skilled in the art will be included within the scope of the following claims.

What is claimed is:

1. In an apparatus for producing concrete pipe using form sets and having a fill station, a pressure head station, a stripping station and turnable means for supporting form sets and moving them successively from station to station, a module having at least two form sets coupled together, said module comprising a supporting base, at least two cores supported on the base, means to position the cores on the base, vibration isolation means between the cores and base to provide for limited relative movement of the cores relative to the base, a jacket positionable over each core to define a space in which the concrete is to be filled to form a finished pipe or the like, connecting means for connecting all jackets in a module together so that the jackets can be handled as a unit, said connecting means including a feed pan connecting the jackets at their upper ends and to receive the concrete at the fill station, movable distributing means in the feed pan to feed the concrete into the form sets, and vibrators combined with each of the cores for vibrating the cores to assist in distributing and compacting the concrete in the form sets.

2. In the apparatus of claim 1, a module in which the distributing means is a rotor rotatable about a central axis in the feed pan, and drive means is provided to selectively rotate said rotor, the drive means being combined with the supporting base, and a drive shaft connecting the drive means and rotor extending between the form sets.

3. In the apparatus of claim 2 in which the drive shaft includes a lower portion and an upper portion, and a coupling connects the lower portion and upper portion so that the jacket can be separated from the cores and supporting base at the stripping station.

4. In the apparatus of claim 1 in which a vibrator is located near the upper end of each core and a vibrator is located near the lower end of each core, the vibrator at the upper end producing vibration of the core in a direction opposite to the direction of vibration produced by the vibrator at the lower end of each core thereby varying both the amplitude and direction of vibration of the core.

5. In the apparatus of claim 4, means combined with the vibrators to withdraw hot air from the upper end of the core and discharge it outside of the core.

6. In the apparatus of claim 1, a pressure head extruder combined with the feed pan at the pressure head station, said extruder including means to apply pressure to the concrete in each of the form sets of the module.

7. In the apparatus of claim 6, supporting means combined with the feed pan to carry the extruder when not in use at the pressure head station.

* * * * *